US006653555B2

(12) United States Patent
Nugent

(10) Patent No.: US 6,653,555 B2
(45) Date of Patent: Nov. 25, 2003

(54) BARE-WIRE INTERCONNECT

(76) Inventor: Steven Floyd Nugent, 3240 NW. 132nd Pl., Portland, OR (US) 97229

( * ) Notice: Subject to any disclaimer, the term of this patent is extended or adjusted under 35 U.S.C. 154(b) by 63 days.

(21) Appl. No.: 10/011,591

(22) Filed: Nov. 6, 2001

(65) Prior Publication Data

US 2003/0085049 A1 May 8, 2003

(51) Int. Cl.[7] ..... H01B 7/00; H01B 7/34
(52) U.S. Cl. ..... 174/27; 174/36
(58) Field of Search ..... 174/27, 28, 36, 174/102 R, 110 R, 254, 255; 439/493, 65, 66, 67

(56) References Cited

U.S. PATENT DOCUMENTS

| | | | | |
|---|---|---|---|---|
| 289,164 A | * | 11/1883 | Strom | 174/111 |
| 289,166 A | * | 11/1883 | Strom | 174/111 |
| 680,150 A | | 8/1901 | Hultman | |
| 716,155 A | | 12/1902 | West | |
| 2,000,355 A | * | 5/1935 | Sichtermann | 174/27 |
| 2,034,026 A | | 3/1936 | Curtis et al. | |
| 2,034,033 A | | 3/1936 | Green et al. | |
| 2,119,853 A | | 6/1938 | Curtis | |
| 2,188,755 A | | 1/1940 | Markuson | |
| 2,510,358 A | | 6/1950 | Wolf | |
| 3,306,793 A | | 2/1967 | Gill et al. | |
| 4,734,544 A | | 3/1988 | Lee | |
| 4,767,890 A | | 8/1988 | Magnan | |
| 4,954,095 A | | 9/1990 | Cogan | |
| 4,997,992 A | | 3/1991 | Low | |
| 5,055,635 A | * | 10/1991 | Landsmann et al. | 174/36 |
| 5,831,210 A | | 11/1998 | Nugent | |
| 5,880,402 A | * | 3/1999 | Nugent | 174/27 |
| 6,066,799 A | | 5/2000 | Nugent | |

FOREIGN PATENT DOCUMENTS

| | | |
|---|---|---|
| DE | 644243 | 4/1937 |
| GB | 218975 | 12/1924 |
| GB | 462532 | 9/1935 |

* cited by examiner

*Primary Examiner*—William H. Mayo, III
(74) *Attorney, Agent, or Firm*—Kolisch Hartwell, P.C.

(57) ABSTRACT

An electrical interconnect is provided with two or more conductors and a conductor support structure, such as a tube, wherein the tube wall includes conductor support sites distributed along the wall. The conductors extend along the wall and across the tube and are maintained in a spaced relationship with respect to one another by the wall and the conductor support sites, which can be perforations through the tube wall, the conductors being inserted through the perforations. The conductor support sites for each conductor can be orthogonally disposed with respect to the sites for other conductors, allowing the conductors to be maintained in a generally helical relationship and each conductor can form a square-wave or trapezoidal-wave pattern along the tube. The interconnect can include cladding about the conductors and tube, such as a ribbed jacket and braided wire shield, and the conductor support structure may be provided with ribbing.

26 Claims, 17 Drawing Sheets

BARE-WIRE INTERCONNECT

BACKGROUND OF THE INVENTION

1. Field of the Invention

The present invention relates to the field of audio electronics, and in particular to electrical interconnect cables.

2. Description of the Related Art

High-bandwidth, low-loss analog pairs, quads and twin-axial type interconnects have been in use since the advent of television. To achieve high-bandwidth and low-loss, conductors were initially spaced apart to minimize capacitance and suspended in an air dielectric. Disc-shaped spacers with holes in them were typically oriented radially in an insulating tube and the conductors passed through them forming a twisted pair or twisted quad construction. To minimize dispersion effects and losses, bare conductors were often used, particularly for video and RF transmission. The bare conductors were suspended within semi-rigid tubing. Flexible tubing could not be used to house the conductors because when the interconnect was sharply flexed, the bare conductors would short to each other. The semi-rigid jackets that were required made these interconnects difficult to handle and failure-prone. Constructions of these types are described in Hultman, U.S. Pat. No. 680,150 (1901), Markuson, U.S. Pat. No. 2,188,755 (1940), Curtis, U.S. Pat. No. 2,119,853 (1935) and U.S. Pat. No. 2,034,026 (1936), Green, U.S. Pat. No. 2,034,033, and Cogan, U.S. Pat. No. 4,954,095 (1990).

An alternate construction is taught by West in U.S. Pat. No. 716,155, which also suspends bare conductors in a semi-rigid tube. West teaches that an accordion-folded insulating strip with holes or slots in it can form a supporting structure for bare conductors. The disadvantage of this folding structure is that it only flexes in one dimension. Lead-coverings are described as jacketing such a cable to shield it and to prevent it from flexing.

With the advent of low-dielectric constant materials such as Teflon and foamed polymers, bare conductor designs were eventually replaced with conformally insulated wires in both coaxial and twin-axial constructions. The conformally insulated wires were more durable, allowed flexibility and eliminated the shorting hazard. Unfortunately, these new materials did not perform quite as well as the bare conductors in air dielectric because their loss and dielectric absorption characteristics were inferior. These characteristics cause the transfer function of the conductors to vary depending upon amplitude and frequency, thereby degrading the signal quality. Dielectric absorption can cause smearing of signals at all audio frequencies due to latent storage of charge in the dielectric. For most video, RF transmission and some digital transmission applications however, the performance of these insulators was sufficient and interconnects could be manufactured at much lower cost. For these reasons, insulated conductors find wide use in electronic signal transmission.

With improvements in audio media, amplifying equipment and loudspeakers for music and theater sound reproduction, the need has increased for high-performance interconnects that can resolve these more accurate signal sources. High-performance interconnects must have low dielectric absorption, low capacitance and low dielectric losses. These goals are all achieved with constructions that comprise bare conductors separated by air dielectric. Such constructions have the effect of substantially improving multi-channel image focus and dynamics at all audio frequencies, creating a more live audio reproduction when compared to insulated conductor designs.

The need for higher performance interconnects has been addressed by several audio interconnect designs that have attempted to approach the optimum configuration of bare conductors suspended in air dielectric. One of these designs utilizes a flexible insulating tube. Two bare or insulated conductors are wrapped around the tube in a "barber-pole" fashion, with interstitial small tubing or fillers wrapped between the two conductors to keep them spaced apart. This construction further requires insulating materials surrounding the conductors to hold them tightly against the outside of the tube and spaced from each other so they do not move when the tube is flexed. These materials for spacing and holding negate the positive effects of having bare conductors. One such construction is described in Low, U.S. Pat. No. 4,997,992.

A second construction involves an extruded insulating tubing, which has one or more smaller tubes, which are integral to the extrusion and inside the larger tubing. The smaller tubes house bare conductors. This construction has the disadvantage that the conductor or conductors must be "fished" through the smaller tubes and these can be quite long. Also, the close proximity of the conductors to the small surrounding tubes will increase dielectric absorption and loss.

A third construction involves disc-shaped spacers, which suspend the conductors within an insulating tube as described in Nugent, U.S. Pat. No. 5,880,402. One conductor between each adjacent pair of spacers is insulated, achieving a half-insulated interconnect. Since one of the two conductors is insulated between each adjacent pair of spacers, the two conductors cannot short together. This construction has the disadvantage of having insulation on half of the conductors, which will cause higher dielectric absorption and loss when compared to bare conductor constructions.

Some of the described twin-axial and suspended-pair constructions are definitely an improvement over fully insulated conductors, but they still suffer from audible dielectric absorption effects.

SUMMARY OF THE INVENTION

The present invention finds application in the field of high-fidelity audio, and particularly to digital and analog audio interconnect cables. The present invention is an interconnection cable that can be used for balanced or single-ended analog signal transmission or digital single-ended or differential signal transmission. The invention includes several flexible constructions that suspend bare conductors in a primarily air dielectric while eliminating the shorting hazard between the conductors.

A first single-ended, twisted-pair interconnect and the preferred embodiment, according to the present invention, begins with a first conductor which is bare or uninsulated and a second conductor which is also bare or uninsulated. Alternatively, the first and/or second conductor can include a conformal or other insulation along all or part of their length. An insulating tube which has uniform perforations along its length forms the supporting structure for the interconnect. The first bare conductor is woven through the perforations in the tube forming a "square-wave" pattern, which is aligned along a first radial line intersecting the radial center of the tube. The second bare conductor is woven through the perforations in the tube forming a "square-wave" pattern along a second radial line, which is 90 degrees rotated from the first radial line and shifted along the longitudinal axis of the tube. This construction creates a twisted-pair geometry that locates a minimum of insulating material in contact with and between the two conductors. There is no shorting hazard between the two bare conductors because of the spacing created by the woven pattern. The spacing of the two bare conductors when woven through the insulating tube minimizes the interconnect capacitance.

A balanced or differential twisted-pair interconnect according to the present invention is constructed identically to the first single-ended, twisted-pair cable, but with the addition of a third insulated conductor located inside the tube and extending the length of the tube. This provides the "ground" conductor that is necessary in a balanced or differential connection. Because this conductor is contained inside the tube, it becomes centered within the tube due to contact with the other conductors. The ground conductor is orthogonal to the other conductors, minimizing its effect on the performance of the interconnect, by reducing coupling with the bare conductors.

A second single-ended, twisted-pair interconnect according to a preferred embodiment begins with a first conductor which is bare or uninsulated and a second conductor which is also bare or uninsulated. Alternatively, the first and/or second conductor can include a conformal or other insulation along all or part of their length. An insulating tube which has perforations along its length forms the supporting structure for the interconnect. The first bare conductor is woven through the perforations in the tube forming a "trapezoidal-wave" pattern, which is aligned along a first radial line intersecting the radial center of the tube. The second bare conductor is woven through the perforations in the tube forming a "trapezoidal-wave" pattern along a second radial line which is 90 degrees rotated from the first radial line. This construction's bare conductors and twisted-pair geometry locates a minimum of insulating material in contact with and between the two conductors. There is no shorting hazard between the two bare conductors because of the spacing created by the woven pattern. The trapezoidal pattern has the additional advantage of using less conductor length to span the length of the insulating tubing.

A balanced or differential twisted-pair interconnect according to the present invention is constructed identically to the second single-ended, twisted-pair cable, but with the addition of a third insulated conductor located inside the tube and extending the length of the tube. This provides the "ground" conductor that is necessary in a balanced or differential connection. Because this conductor is contained inside the tube, it becomes centered within the tube due to contact with the other conductors.

The twisted-pair cable assemblies can be surrounded by an insulating jacket to prevent shorting to the bare conductors, which is corrugated to minimize contact of the jacket with the bare conductors. Alternatively, an insulating jacket can surround the woven cable assembly, which has internal ribs to minimize contact of the jacket with the bare conductors.

If a metallic shield is applied to surround the corrugated jacket or the jacket with internal ribs, the jackets will create a space between the bare conductors and the metallic shield, reducing interconnect capacitance over conventional constructions. The surrounding metallic shield may consist of woven wires or metallic foil or both.

Multiple pairs of bare conductors, each woven through an insulating tube can also be combined in parallel to form a digital or analog interconnect cable. Component electrical characteristics and length of the interconnect along with the frequency range of interest affect the choice of the number of conductors and the conductor wire gauge required to optimize the quality of signal transmission. To optimize the high-frequency response of an analog interconnect, the wire gauge is limited to about 20 AWG due to skin-effect. Improved high-frequency response will generally be achieved with smaller diameter gauges (22–26 AWG). To optimize the bass response and dynamics of the interconnect, a sufficient number of pairs must be connected in parallel to achieve a low inductance. A two-pair construction can include four bare conductors that are woven through an insulating tube, each having a square-wave pattern.

The constructions of the present invention will become more apparent from the following detailed description in conjunction with the accompanying drawings.

DETAILED DESCRIPTION OF THE INVENTION

The present invention is an electrical interconnection cable in which conductors, preferably uninsulated, are supported by weaving them through a perforated insulating tube. The patterns of weaving can vary, but typically they have the attribute that the conductors are separated to minimize capacitance and supported to prevent shorting when the interconnect is flexed. Some woven patterns will create spaced twisted pairs with two conductors. Other patterns involve four conductors, of which some conductors may be connected in parallel at the end terminations. The woven assemblies can be further enclosed in several types of insulated tubing, which can have surrounding overall shielding.

Figure 1A:
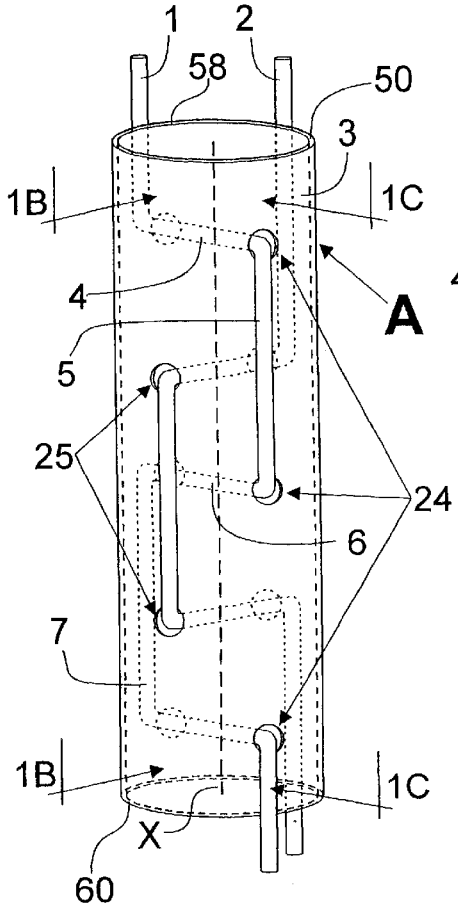
FIG. 1A is an isometric view of an interconnect A of the invention, the preferred embodiment, in which the woven pattern of each of the two bare conductors resembles a square wave.

Referring to FIG. 1A of the drawings, the preferred embodiment of the invention, an interconnect A, includes a first conductor 1, a second conductor 2, and a conductor support structure, such as an insulating tube 3, defining a central longitudinal axis X and first end 58 and second end 60. The conductors are all preferably composed of solid copper, silver, tinned copper or silver plated copper, most preferably silver, and in the same gauge, generally ranging from 26 AWG to 18 AWG, preferably 26 AWG. Preferably, conductors 1 and 2 are bare wires, but alternatively one or both may be partially or completely insulated. Preferably conductors 1 and 2 are each formed of two or more strands of the same gauge wire, most preferably three strands, entwined together. Perforated tube 3 may be composed of PVC, Teflon, polypropylene, polyethylene or other flexible insulating material. It will be understood that tube 3, as well as the embodiments to be described below, can be flexed and/or provided with a nominally flexed configuration, such as a curved configuration, and still define the central longitudinal axis X.

Figure 1B:
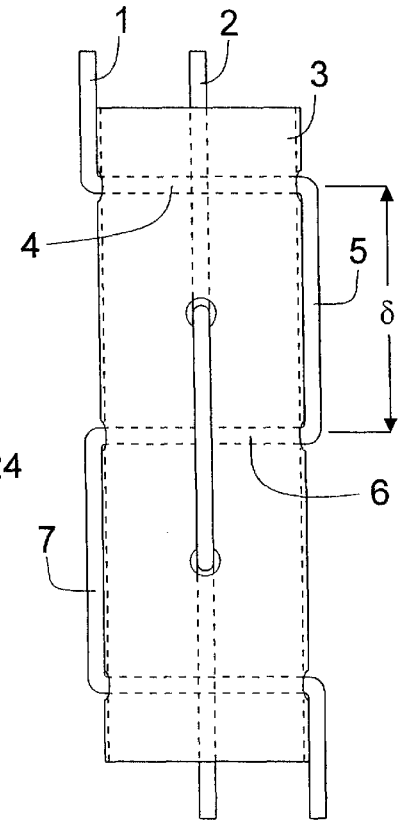
FIG. 1B is a side view of interconnect A of the invention.

Tubing 3 includes a support surface, such as a wall 50 that is perforated with a first and second series of holes, which holes preferably are each evenly spaced at an interval distance δ(FIG. 1B). The wall extends generally parallel to the central axis X and interconnects ends 58 and 60 of tube 3. The holes provide a plurality of conductor support sites distributed along the wall. The first series of holes 24 extends through two sides of the wall of tubing 3, all holes 24 preferably being radially aligned, i.e., each hole has a central axis that is generally normal to, and generally crossing or intersecting the central axis X of tubing 3. The two sides of the wall through which the holes 24 extend are typically separated by about 180°. The second series of holes 25 extends through two sides of the wall of tubing 3, also typically separated by about 180°, all holes 25 preferably being radially aligned, and rotated about 90 degrees radially and offset axially from the first series of holes 24 by a distance of typically about ½δ.

Referring to FIGS. 1A and 1B, conductor 1 is woven through the first series of holes 24 in tubing 3 forming a "square-wave" pattern comprised of four repeating segments. Segment 4 extends radially through tube 3, crossing axis X, segment 5 extends axially along the outside of tube 3, segment 6 extends radially back through tube 3, crossing axis X, and segment 7 extends axially along the outside of tube 3.

Figure 1C:
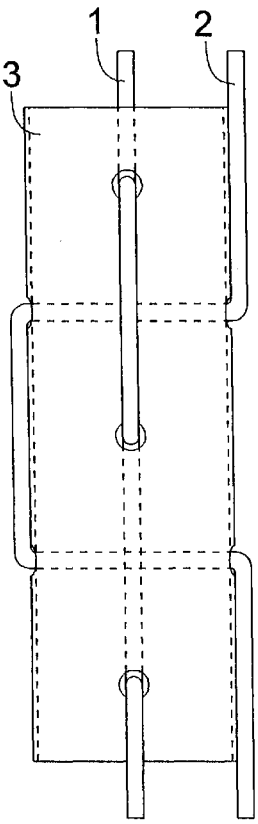
FIG. 1C is a side view of interconnect A of the invention.

Referring to FIGS. 1A and 1C, conductor 2 is woven through the second series of holes 25 in tubing 3 forming a "square-wave" pattern comprised of four repeating segments similar to that described for conductor 1. Thus, conductors 1 and 2 extend along alternating segments of wall 50 from adjacent one end of the conductor support structure to adjacent the other, and the conductors are maintained in a spaced relationship with respect to one another by conductor support sites, preferably the holes. Conductors 1 and 2 are disposed in a generally helical relationship with respect to one another, which tends to cancel induced noise. The conductor support sites may alternatively be provided by a variety of means—for example the conductor support structure may be a spiral structure or a web-like structure providing a surface with conductor support sites that may be hooks, loops, holes, or other suitable structure.

Figure 2A:
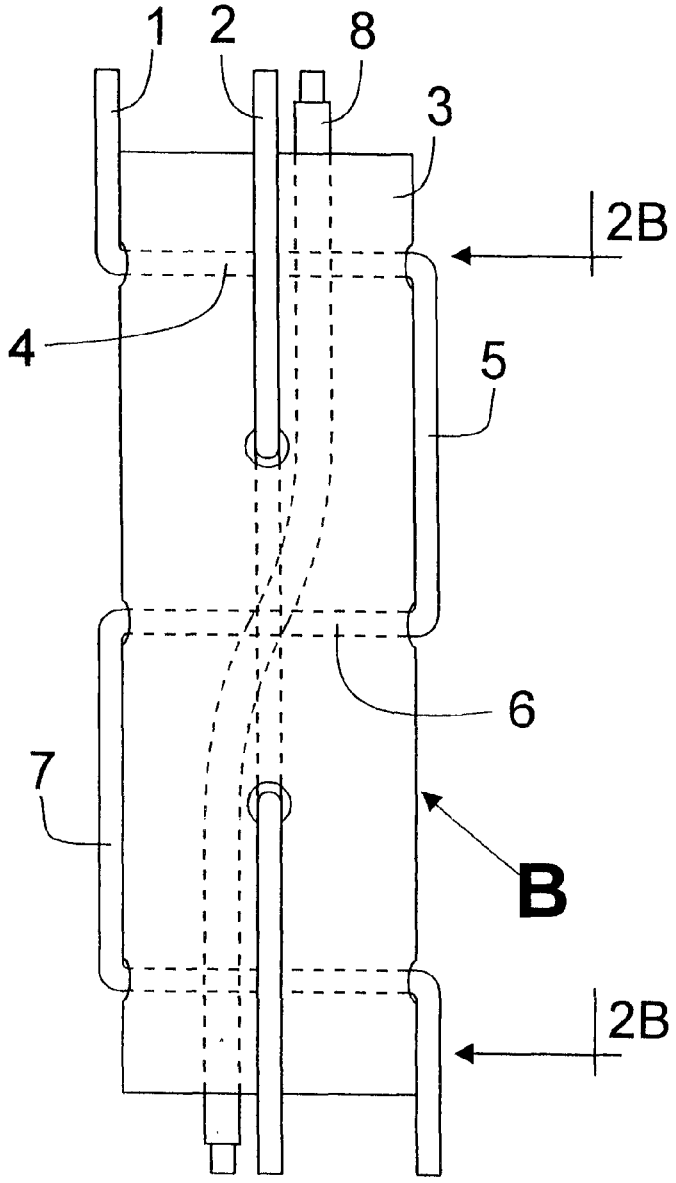
FIG. 2A is a side view of interconnect B of the invention, in which the woven pattern of each of two bare conductors resembles a square-wave and a third insulated conductor extends inside the length of the tube, weaving through the two bare conductors.
Figure 2B:
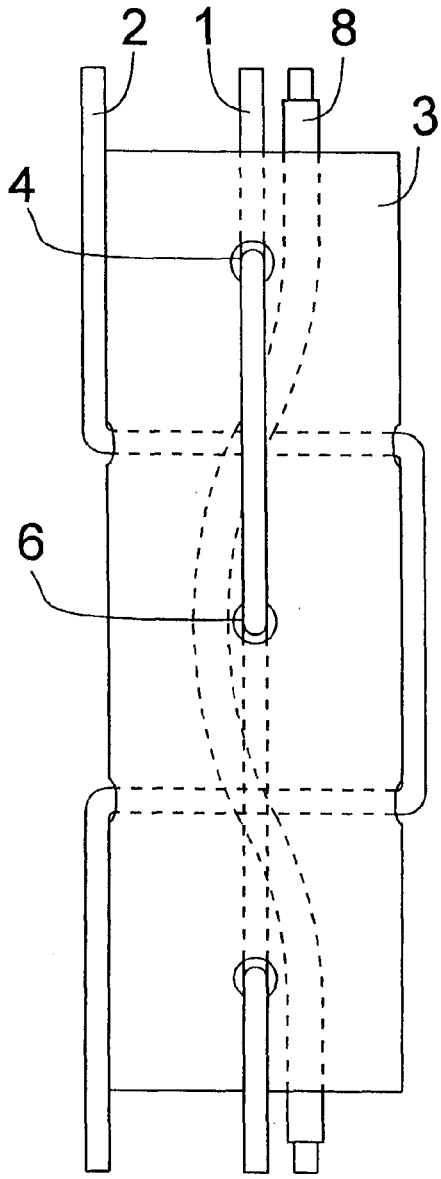
FIG. 2B is a side view of interconnect B of the invention, rotated radially 90 degrees from the view of FIG. 2A.

Referring to FIGS. 2A and 2B, an interconnect B includes conductor 8, which is woven between conductors 1 and 2 inside tube 3. Conductor 8 weaves through the radial segments of conductors 1 and 2, as illustrated by radial segments 4 and 6 of conductor 1 in FIG. 2B. The weaving of conductor 8 between conductors 1 and 2 causes conductor 8 to be suspended in the center of tube 3, and conductor 8 is disposed generally along axis X. Conductor 8 can be used for grounding between components in balanced or differential interconnections. Conductor 8 typically is insulated if one or both conductors 1 and 2 are substantially uninsulated.

Figure 3A:
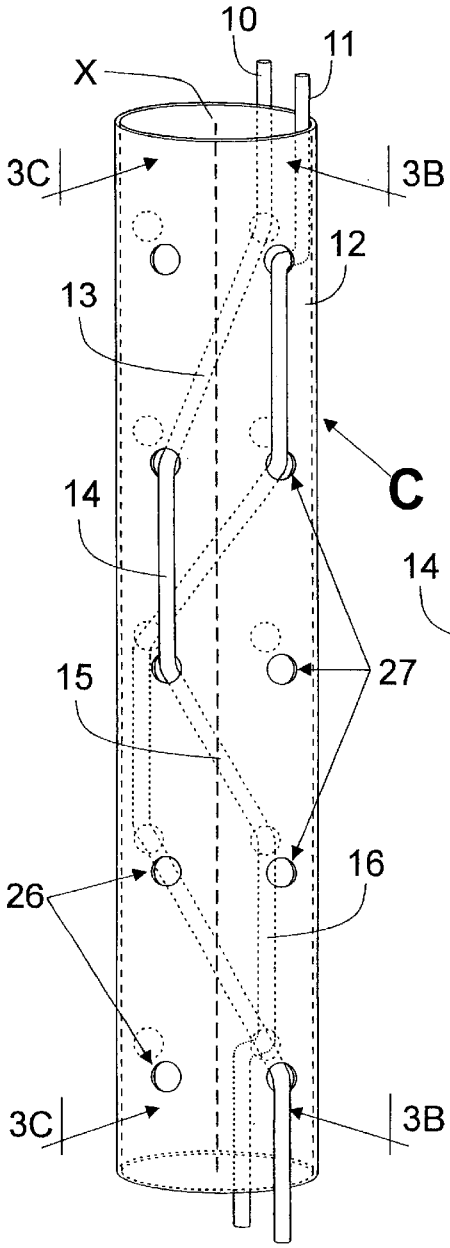
FIG. 3A is an isometric view of an interconnect C of the invention, an alternate embodiment, in which the woven pattern of each of the two bare conductors resembles a trapezoidal wave.

Referring to FIG. 3A of the drawings, in an alternate embodiment of the invention, an interconnect C comprises a first conductor 10, a second conductor 11, and an insulating tube 12. The conductors are all preferably composed of solid copper, silver, tinned copper or silver plated copper, or other conductive material, and in the same gauge, generally ranging from 26 AWG to 18 AWG. Insulating tube 12 may be composed of PVC, Teflon, polypropylene, polyethylene or other flexible insulating material.

Figure 3B:
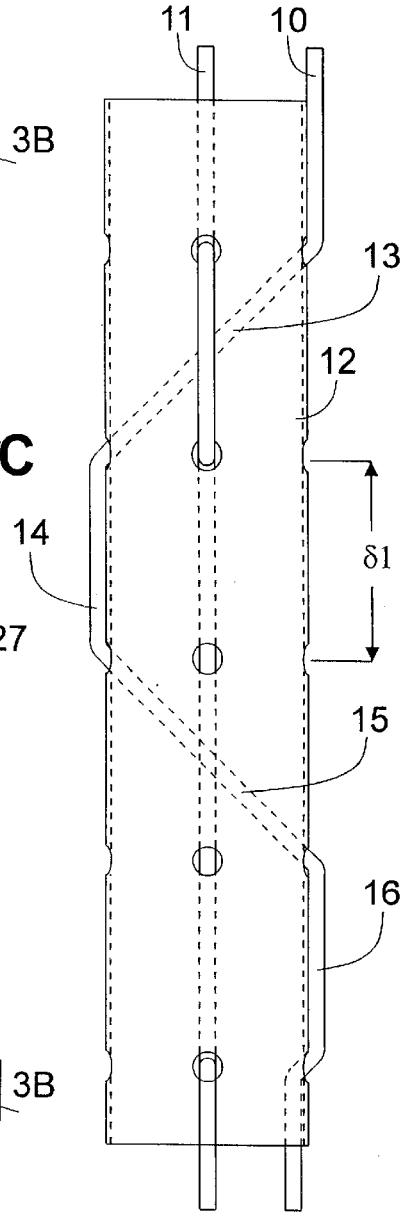
FIG. 3B is a side view of interconnect C of the invention.

Tubing 12 is perforated with a first and second series of holes which are each evenly spaced at an interval distance $\delta 1$ (FIG. 3B). The first series of holes 26 extends through two sides of wall of tubing 12, all holes 26 preferably being radially aligned. The second series of holes 27 extends through two sides of the wall of tubing 12, all holes 27 preferably being radially aligned, rotated 90 degrees radially and typically axially aligned with the first series of holes 26.

Referring to FIGS. 3A and 3B, conductor 10 is woven through the first series of holes 26 in tubing 12 forming a "trapezoidal-wave" pattern comprised of four repeating segments. Segment 13 extends radially and diagonally through tube 12, crossing axis X, segment 14 extends axially along the outside of tube 12, segment 15 extends radially and diagonally back through tube 12, crossing axis X, and segment 16 extends axially along the outside of tubing 12.

Particularly for the trapezoidal pattern, but also for the square wave pattern, the holes need not be radially aligned, but instead may extend through the wall at an angle. For the trapezoidal pattern, the holes may be angled to correspond to the direction of conductors threaded through the holes.

Figure 3C:
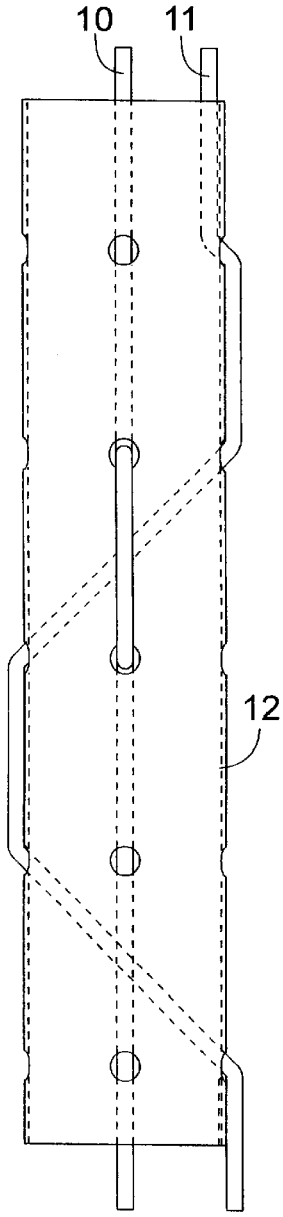
FIG. 3C is a side view of interconnect C of the invention.

Referring to FIGS. 3A and 3C, conductor 11 is woven through the second series of holes 27 in tubing 12 forming a "trapezoidal-wave" pattern comprised of four repeating segments similar to that described for conductor 10, but the weaving of the conductors is offset axially such that the internal diagonal segments 13 and 15 of conductor 10 occur at the same axial locations as the axial segments of conductor 11 that route on the outside of tube 12. This construction prevents shorting between conductor 10 and conductor 11, if the conductors are uninsulated, and maintains separation between the conductors to minimize capacitance.

Figure 4A:
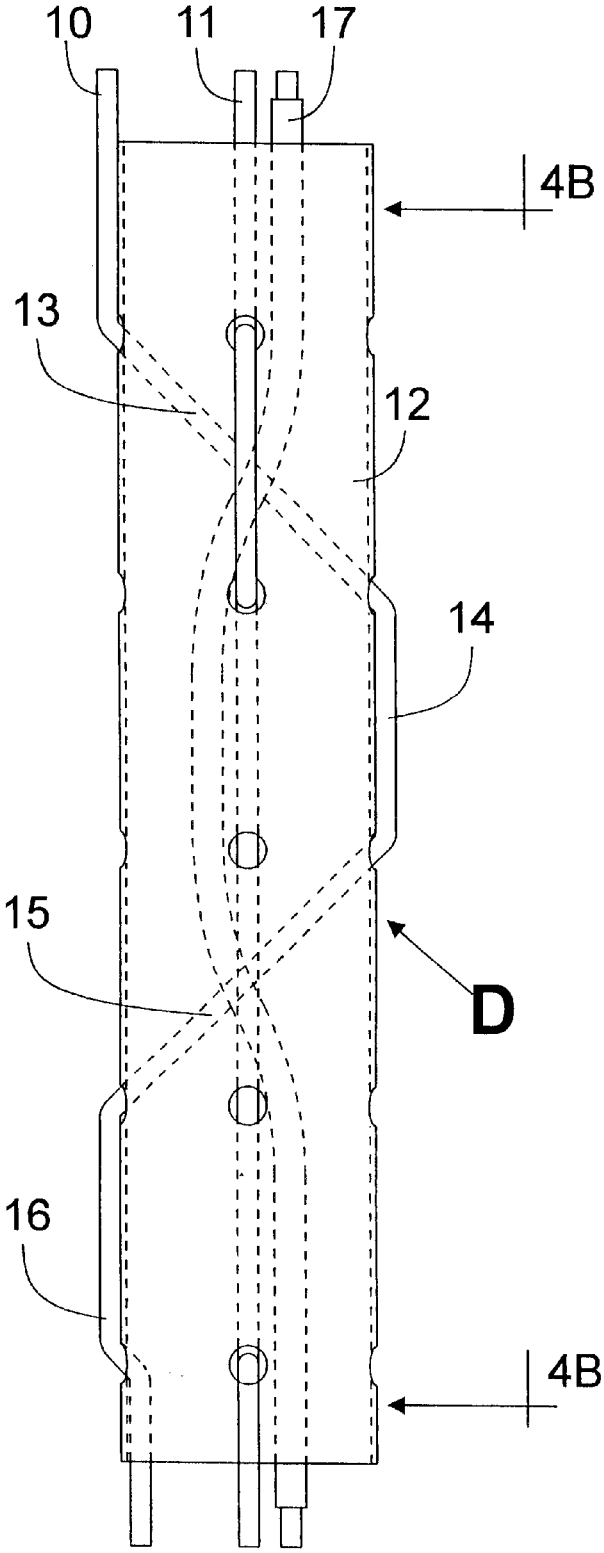
FIG. 4A is a side view of interconnect D of the invention, in which the woven pattern of each of two bare conductors resembles a trapezoidal-wave and a third insulated conductor extends inside the length of the tube, weaving through the two bare conductors.
Figure 4B:
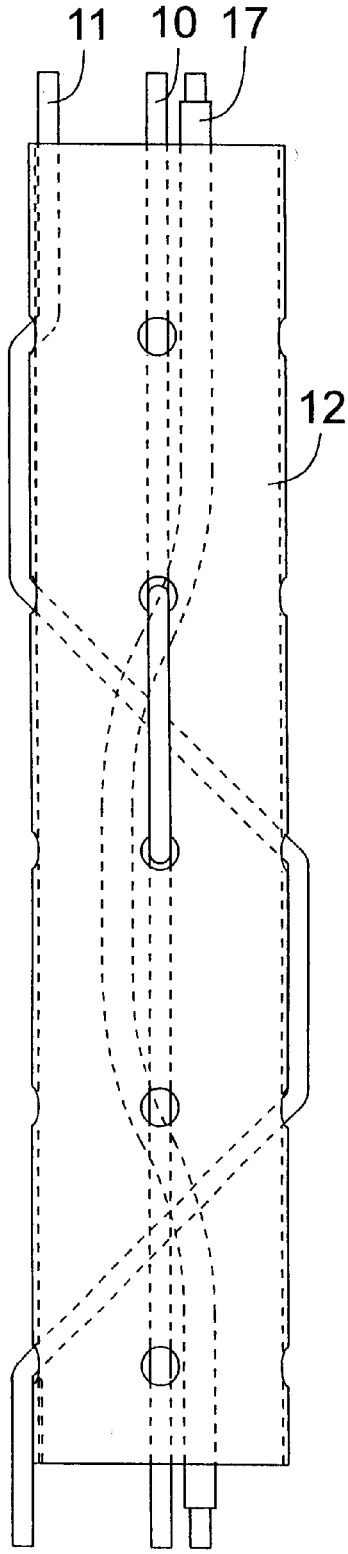
FIG. 4B is a side view of interconnect D of the invention, rotated radially 90 degrees from the view of FIG. 4A.

Referring to FIGS. 4A and 4B, an interconnect D includes conductor 17, which is woven between conductors 10 and 11 inside tube 12. Conductor 17 alternately weaves through the internal segments of conductors 11 and 12. Alternately weaving conductor 17 between conductors 10 and 11 causes conductor 17 to be suspended in the center of tube 12. Insulated conductor 17 can be used for grounding between components in balanced or differential interconnections. Conductor 17 typically is insulated if one or both conductors 10 and 11 are substantially uninsulated.

Figure 5:
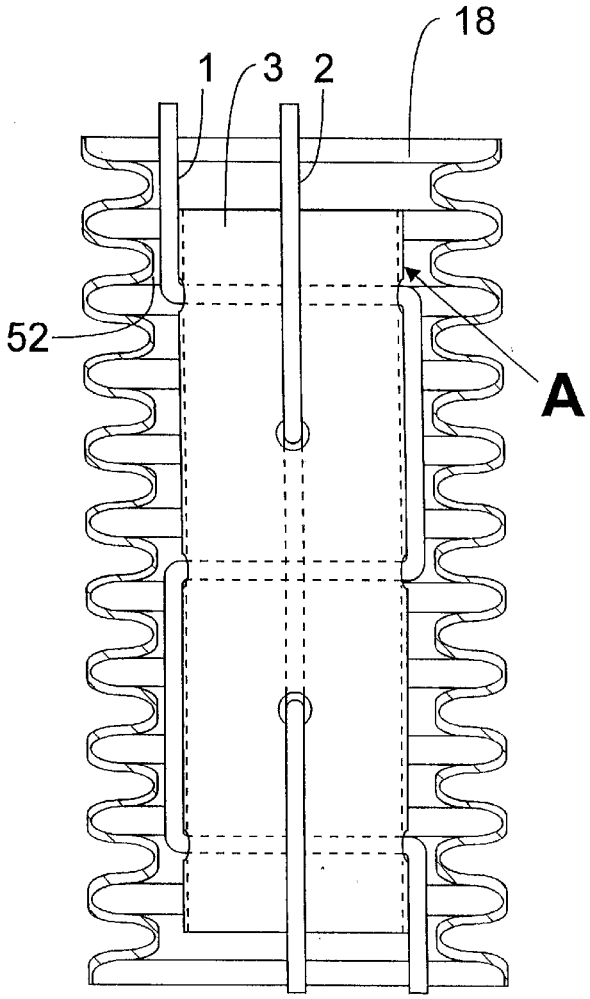
FIG. 5 illustrates interconnect A of the invention, with a section view of a surrounding corrugated jacket.

Referring to FIG. 5, interconnect A includes a surrounding insulating jacket 18, preferably corrugated or otherwise including a plurality of spaced ribs 52 facing conductors 1 and 2, to prevent shorting of metal objects to conductors 1 and 2, and otherwise protect the conductors and tube from damage. FIG. 5 is a section view showing interconnect A surrounded by jacket 18. Jacket 18 contacts conductors 1 and 2 only at the peaks of internal ribs 52 of jacket 18, for minimal dielectric absorption.

Figure 6:
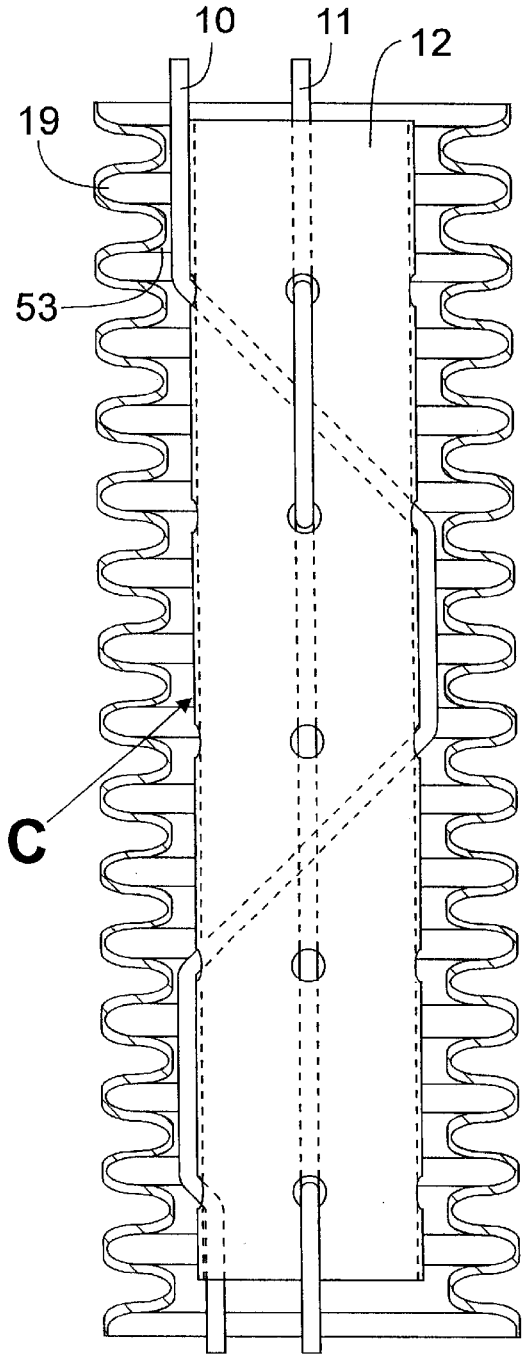
FIG. 6 illustrates interconnect C of the invention, with a section view of a surrounding corrugated jacket.

Referring to FIG. 6, interconnect C includes a surrounding insulating corrugated jacket 19, shown in section view, to prevent metal objects from shorting to conductors 10 and 11 and to protect the conductors, as for interconnect A. Jacket 19 contacts conductors 10 and 11 only at the peaks of internal ribs 53, for minimal dielectric absorption.

Figure 7:
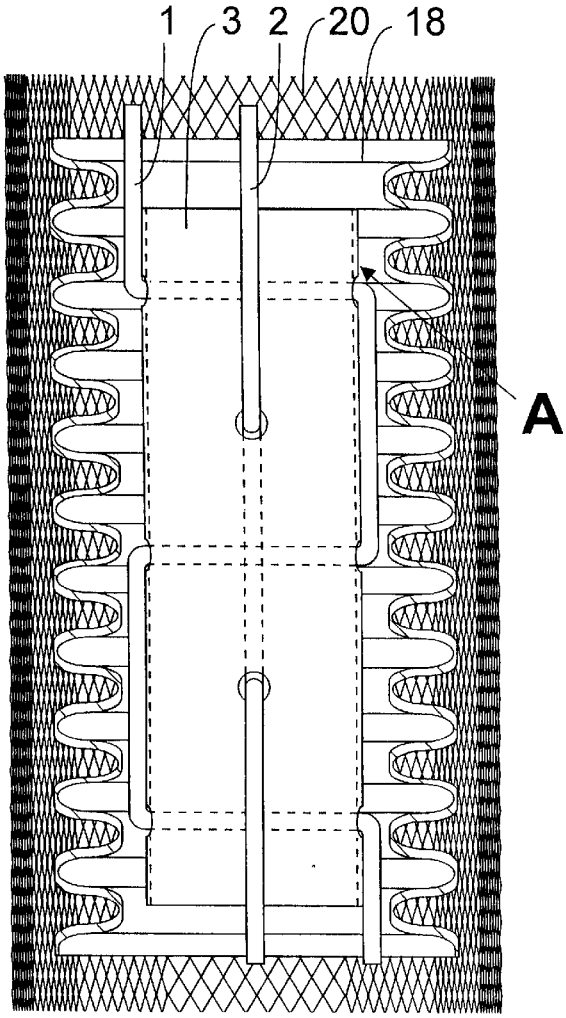
FIG. 7 illustrates interconnect A of the invention, with a section view of a surrounding corrugated jacket further surrounded by a woven-wire shield.

Referring to FIG. 7, interconnect A includes a surrounding insulating corrugated jacket 18, shown in section view, surrounded by an overall braided conducting shield 20. The corrugations of jacket 18 are preferred over conventional conformal jacketing, because, while separating the overall shield 20 from conductors 1 and 2, they minimize interconnect capacitance.

Figure 8:
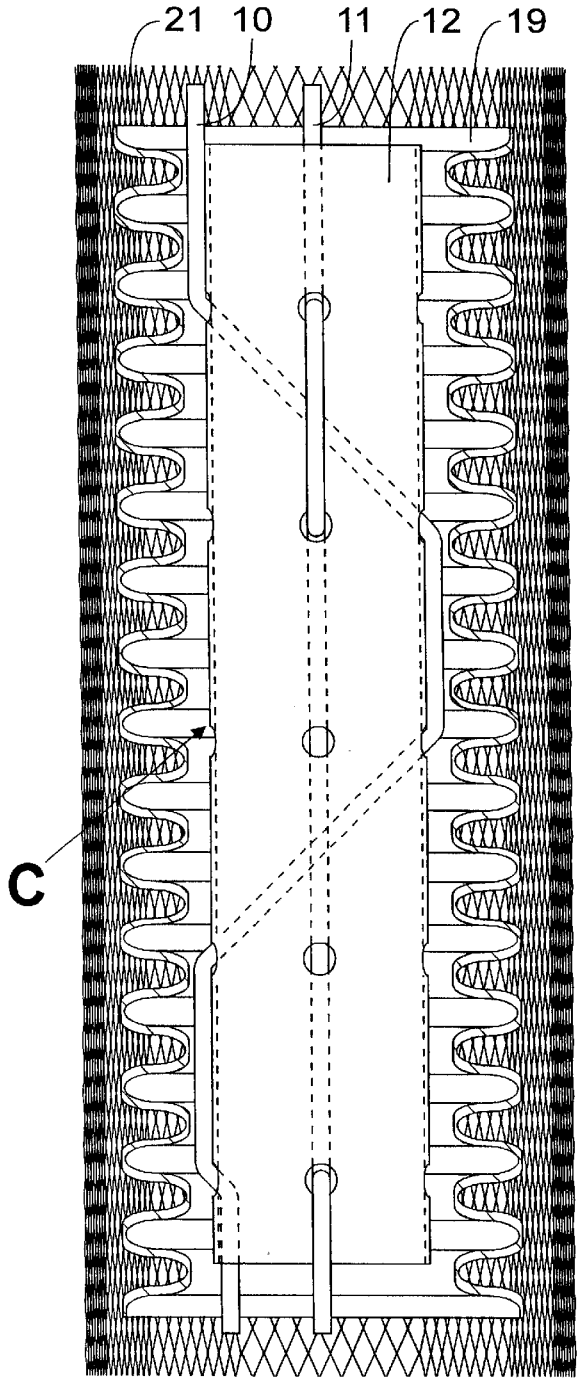
FIG. 8 illustrates interconnect C of the invention, with a section view of a surrounding corrugated jacket further surrounded by a woven-wire shield.

Referring to FIG. 8, interconnect C includes a surrounding insulating corrugated jacket 19, shown in section view, surrounded by an overall braided conducting shield 21, as for interconnect A.

Figure 9:
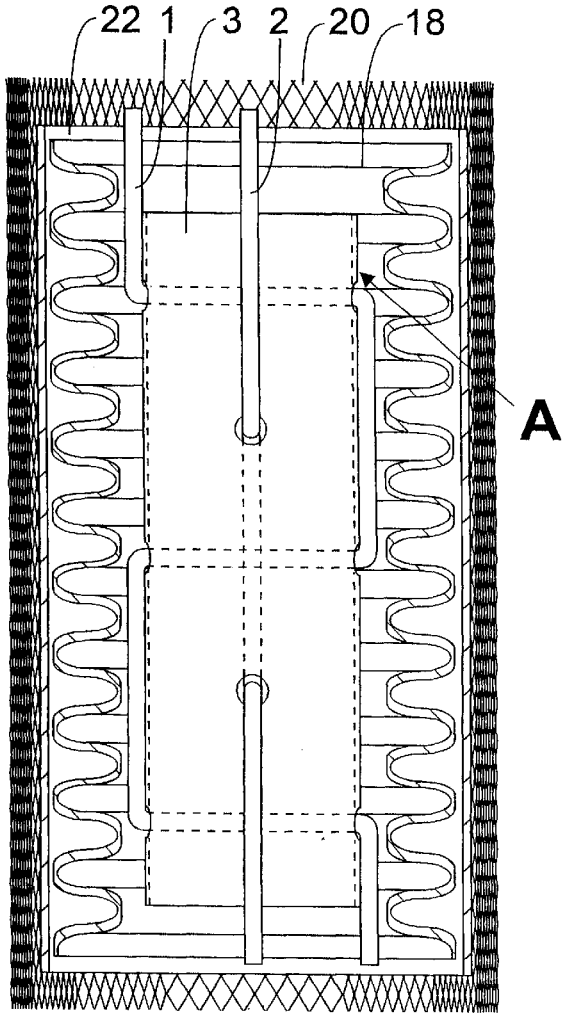
FIG. 9 illustrates interconnect A of the invention, with a section view of a surrounding corrugated insulating jacket surrounded by a helically wrapped metal foil shield and further surrounded by a woven-wire shield.

Referring to FIG. 9, interconnect A includes a braided conducting shield 20 surrounding a helically wrapped metal foil shield 22, which in turn surrounds an insulating corrugated jacket 18, shown in section view. The helically wrapped foil shield 22 improves shielding effectiveness over the woven shield 20 alone.

Figure 10:
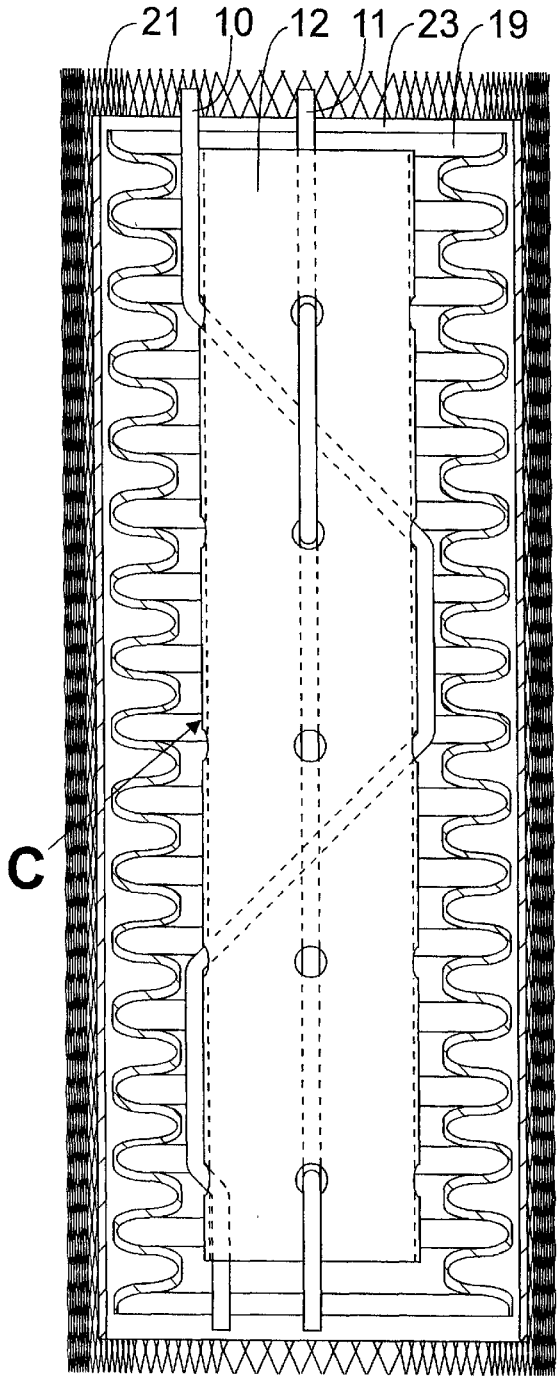
FIG. 10 illustrates interconnect C of the invention, with a section view of a surrounding corrugated insulating jacket surrounded by a helically wrapped metal foil shield and further surrounded by a woven-wire shield.

Referring to FIG. 10, interconnect C includes a braided conducting shield 21 surrounding a helically wrapped metal foil shield 23, which in turn surrounds an insulating corrugated jacket 19, shown in section view. The helically wrapped foil shield 23 improves shielding effectiveness over the woven shield 21 alone.

Figure 11B:
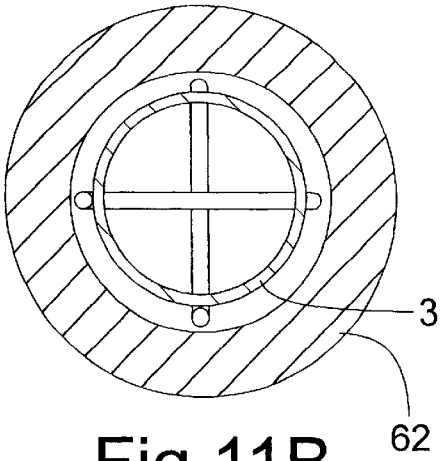
FIG. 11B illustrates a top view of FIG. 11A.
Figure 11A:
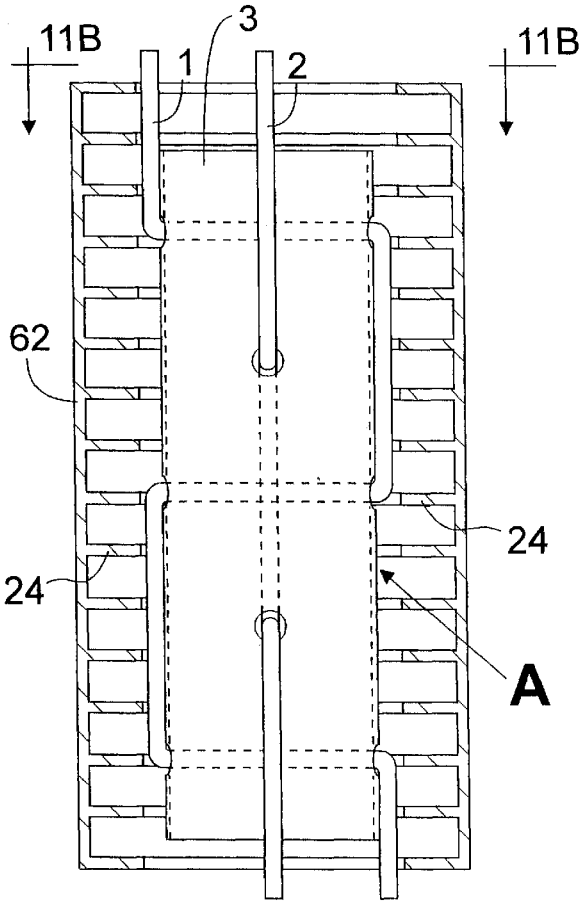
FIG. 11A illustrates interconnect A of the invention, with a section view of a surrounding insulating jacket with internal ribs.

Referring to FIG. 11A and 11B, interconnect A can be surrounded by an insulating jacket 62 with internal radial ribs 24. Only the internal ribs 24 of the insulating jacket contact conductors 1 and 2.

Figure 12:
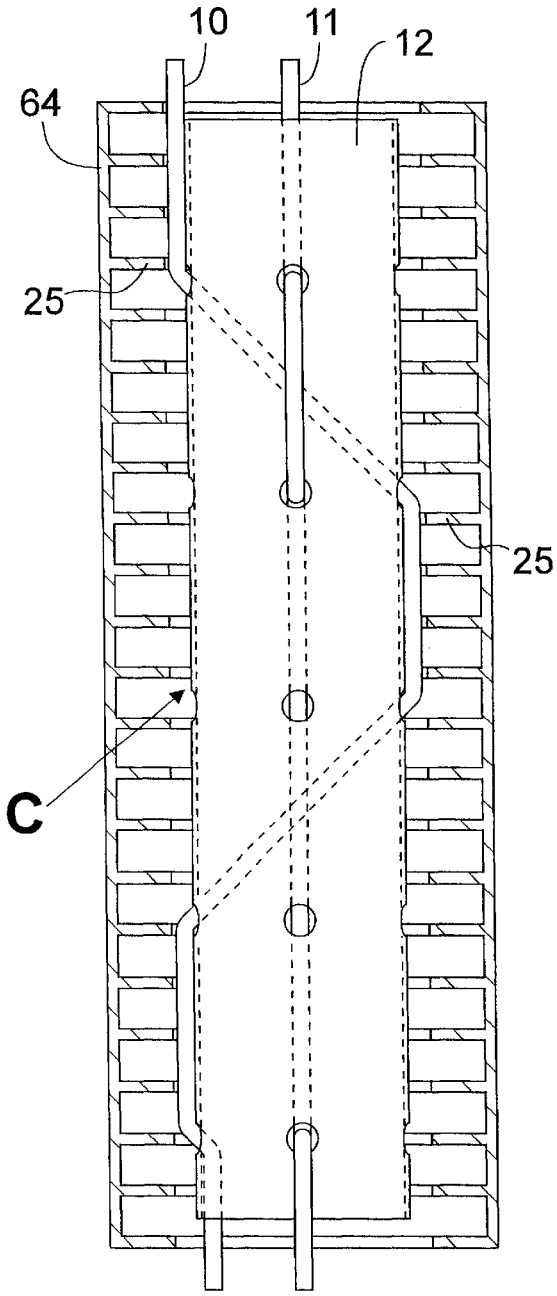
FIG. 12 illustrates interconnect C of the invention, with a section view of a surrounding insulating jacket with internal ribs.

Referring to FIG. 12, interconnect C can be surrounded by an insulating jacket 64 with internal radial ribs 25. Only the internal ribs 25 contact conductors 1 and 2.

Figure 13:
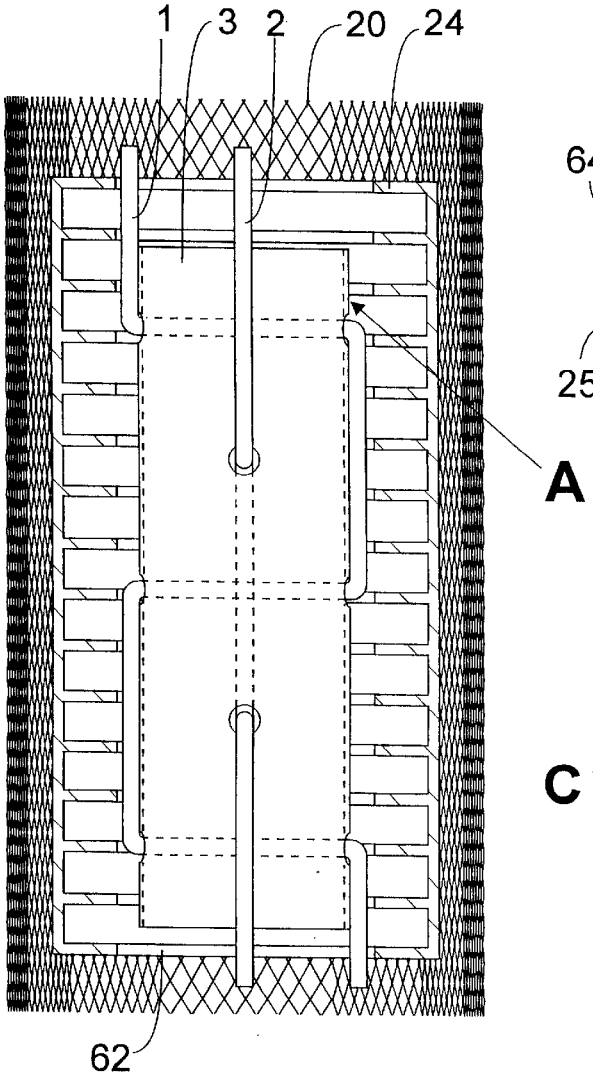
FIG. 13 illustrates interconnect A of the invention, with a section view of a surrounding insulating jacket with internal ribs, further surrounded by a woven metallic shield.

Referring to FIG. 13, interconnect A can be surrounded by insulating jacket 62 with internal radial ribs 24, which is further surrounded by a woven conductive shield 20.

Figure 14:
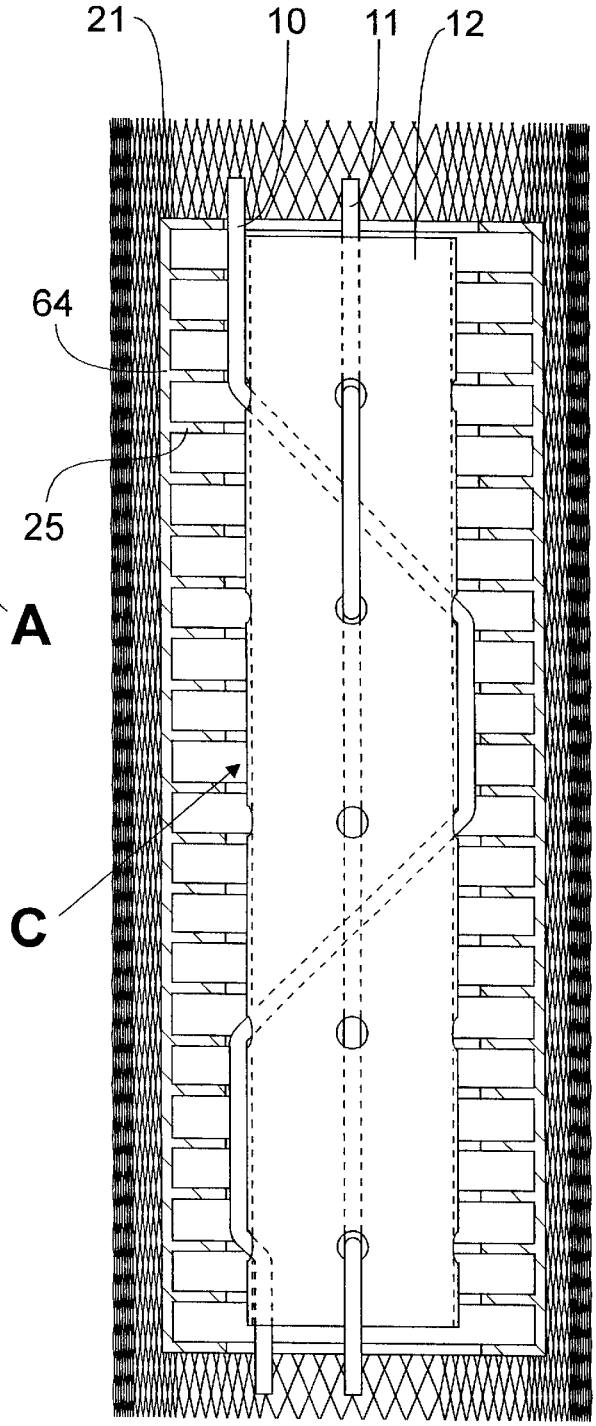
FIG. 14 illustrates interconnect C of the invention, with a section view of a surrounding insulating jacket with internal ribs, further surrounded by a woven metallic shield.

Referring to FIG. 14, interconnect C can be surrounded by insulating jacket 64 with internal radial ribs 25, which is further surrounded by a woven conductive shield 21.

Figure 15:
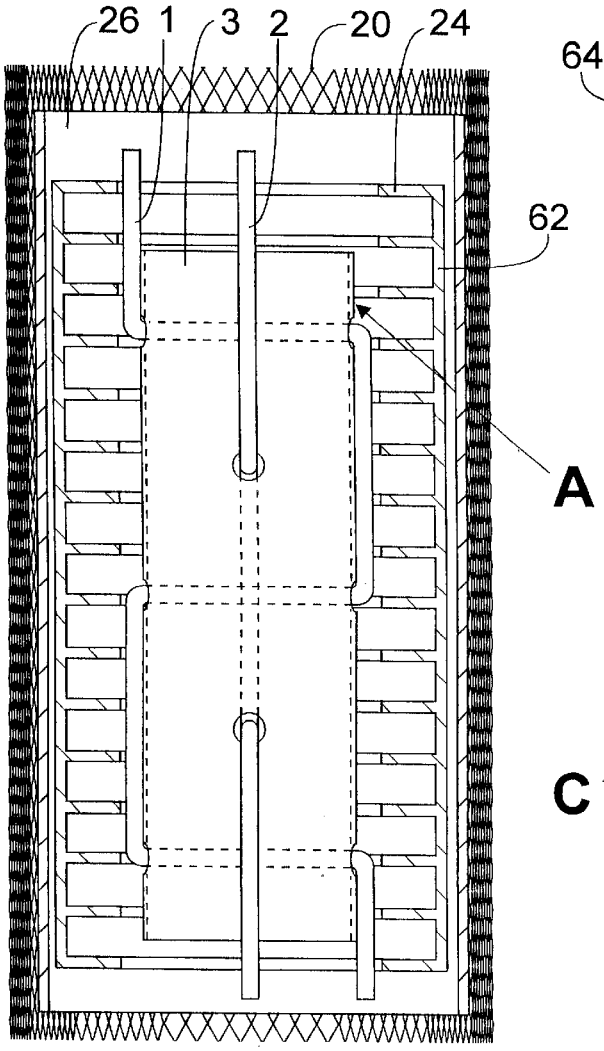
FIG. 15 illustrates interconnect A of the invention, with a section view of a surrounding insulating jacket with internal ribs, further surrounded by a spiral-wrapped foil shield surrounded by a woven metallic shield.

Referring to FIG. 15, interconnect A can be surrounded by insulating jacket 62 with internal radial ribs 24, which is further surrounded by a spiral-wrapped foil shield 26 and a woven conductive shield 20.

Figure 16:
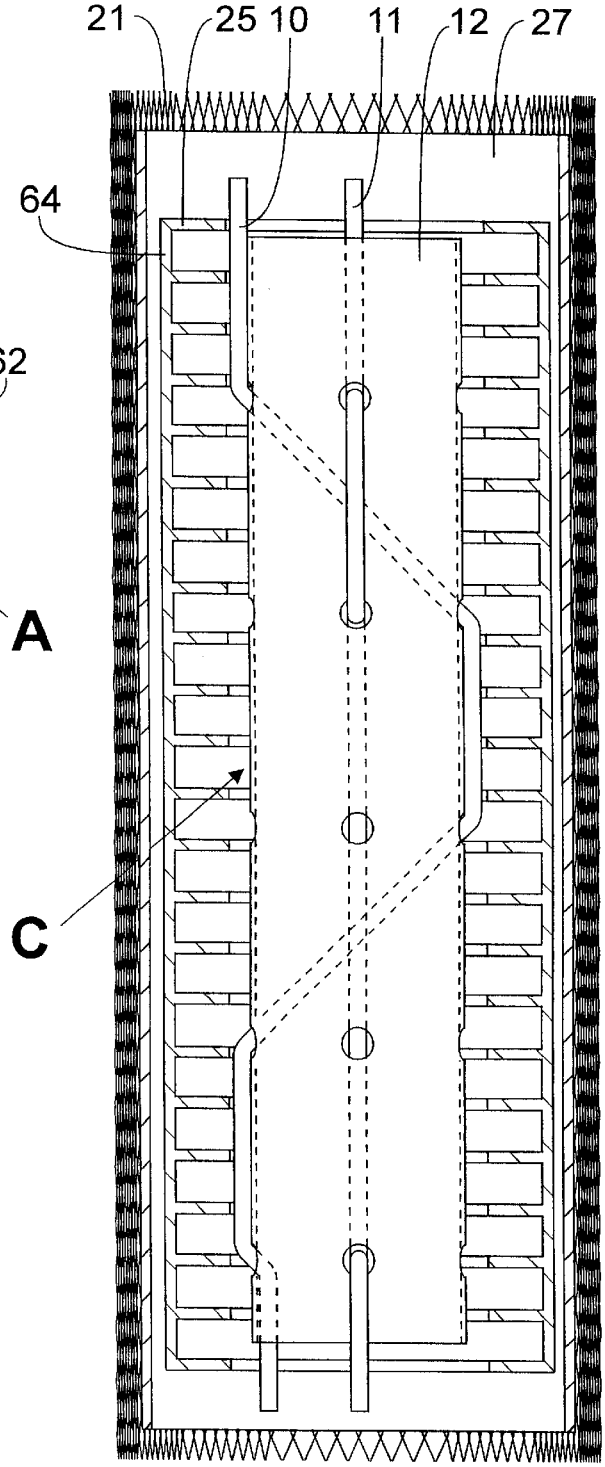
FIG. 16 illustrates interconnect C of the invention, with a section view of a surrounding insulating jacket with internal fibs, further surrounded by a spiral-wrapped foil shield surrounded by a woven metallic shield.

Referring to FIG. 16, interconnect C can be surrounded by insulating jacket 64 with internal radial ribs 25, which is further surrounded by a spiral-wrapped foil shield 27 and a woven conductive shield 21.

Figure 17B:
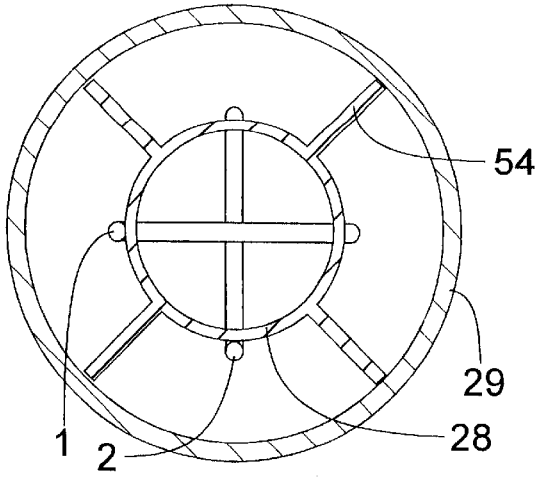
FIG. 17B illustrates a top view of FIG. 17A.
Figure 17A:
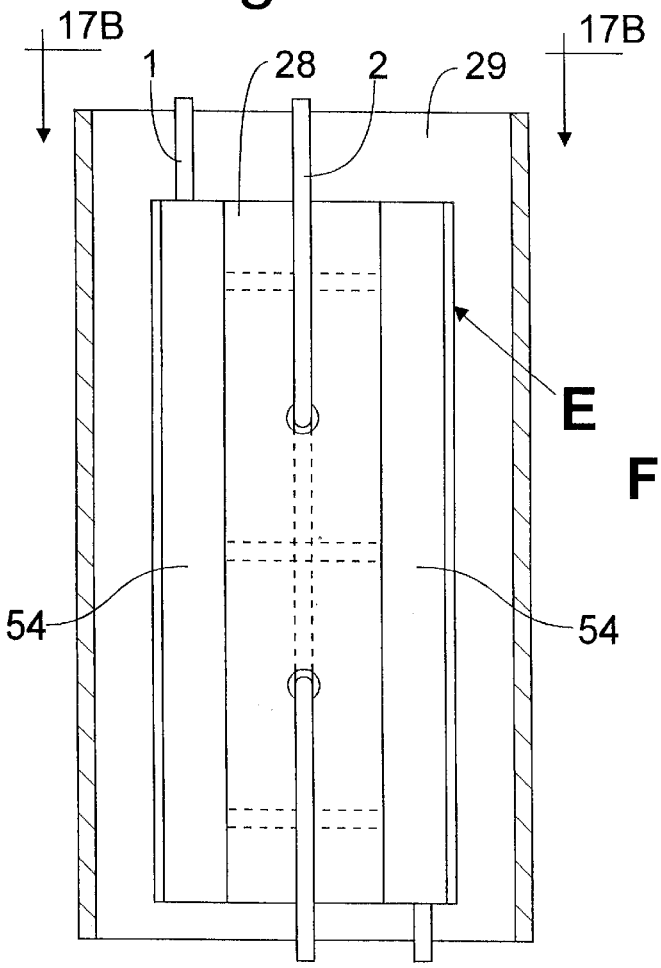
FIG. 17A illustrates an interconnect E of the invention, in which the insulating perforated tube has external ribs for spacing a tubular jacket away from the bare conductors.

Referring to FIG. 17A and 17B, yet another embodiment, interconnect E includes a conductor support structure, such as perforated, insulative tube 28, which is similar to that of interconnect A, but with the addition of external ribs or fins 54 that can space a surrounding tubular jacket 29 away from conductors 1 and 2.

Figure 18:
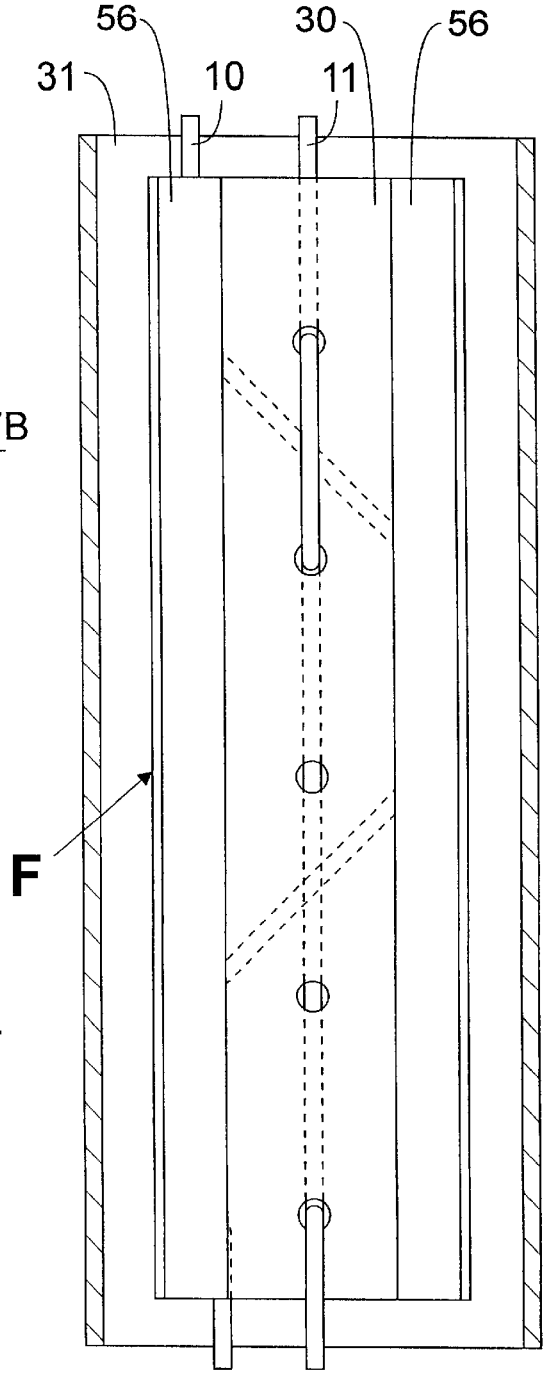
FIG. 18 illustrates an interconnect F of the invention, in which the insulating perforated tube has external ribs for spacing a tubular jacket away from the bare conductors.

Referring to FIG. 18, yet another embodiment, interconnect F includes a conductor support structure, such as perforated, insulative tube 30, which is similar to that of interconnect C, but with the addition of external ribs or fins 56 that can space a surrounding tubular jacket 31 away from conductors 10 and 11.

Figure 19:
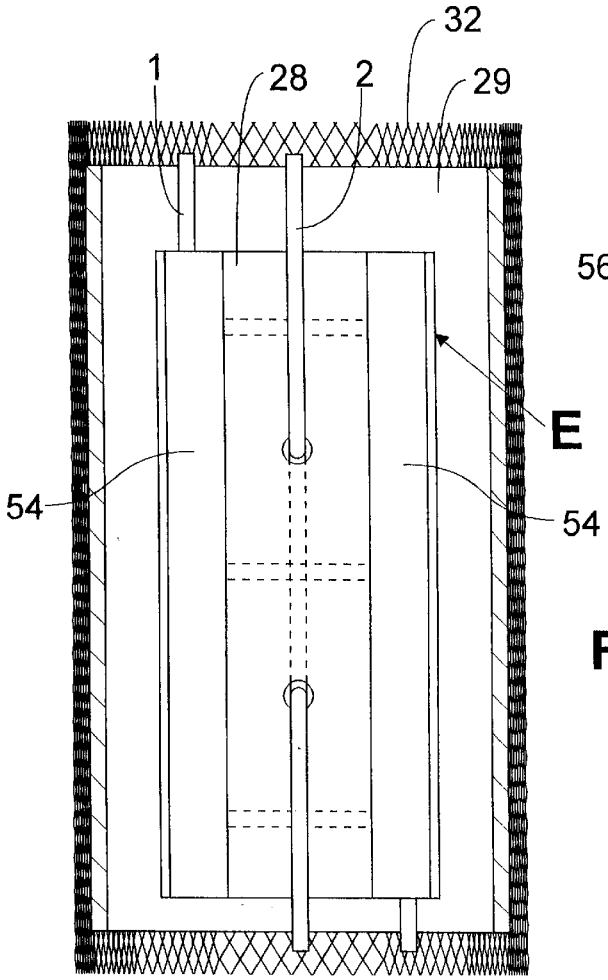
FIG. 19 illustrates interconnect E of the invention, in which the insulating perforated tube has external ribs for spacing a tubular jacket away from the bare conductors and the jacket is surrounded by a woven metallic shield.

Referring to FIG. 19, interconnect E includes a woven metallic shield 32 that surrounds tubular jacket 29.

Figure 20:
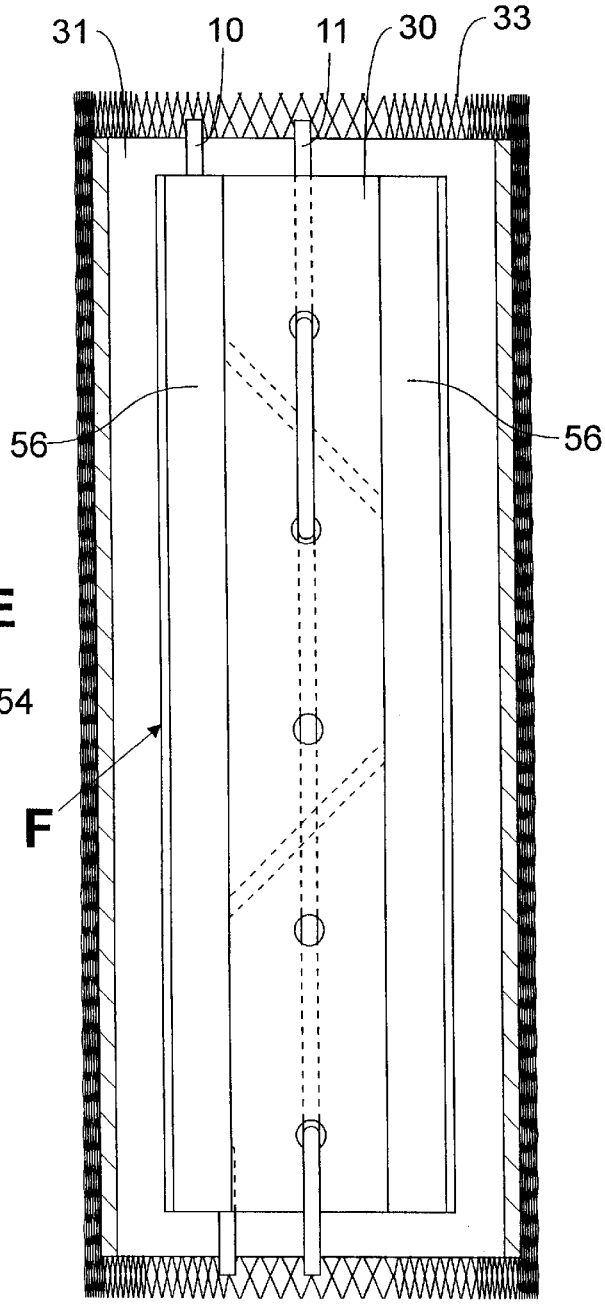
FIG. 20 illustrates interconnect F of the invention, in which the insulating perforated tube has external ribs for spacing a tubular jacket away from the bare conductors and the jacket is surrounded by a woven metallic shield.

Referring to FIG. 20, interconnect F includes a woven metallic shield 33 that surrounds tubular jacket 31.

Figure 21:
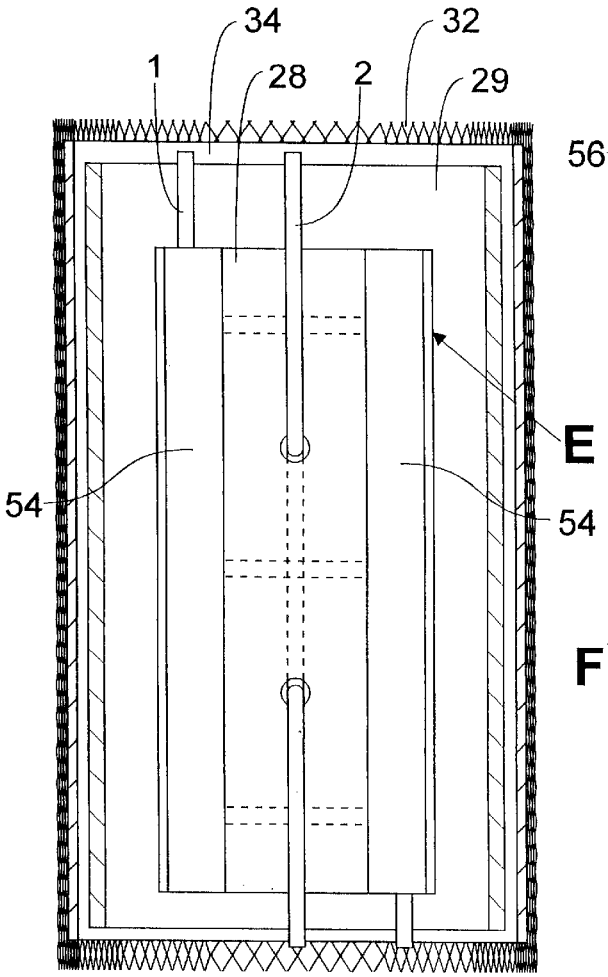
FIG. 21 illustrates interconnect E of the invention, in which the insulating perforated tube has external ribs for spacing a tubular jacket away from the bare conductors and the jacket is surrounded by a spiral-wrapped foil shield surrounded by a woven metallic shield.

Referring to FIG. 21, interconnect E includes a spirally wrapped metallic shield 34, surrounded by a woven shield 32, and surrounding tubular jacket 29.

Figure 22:
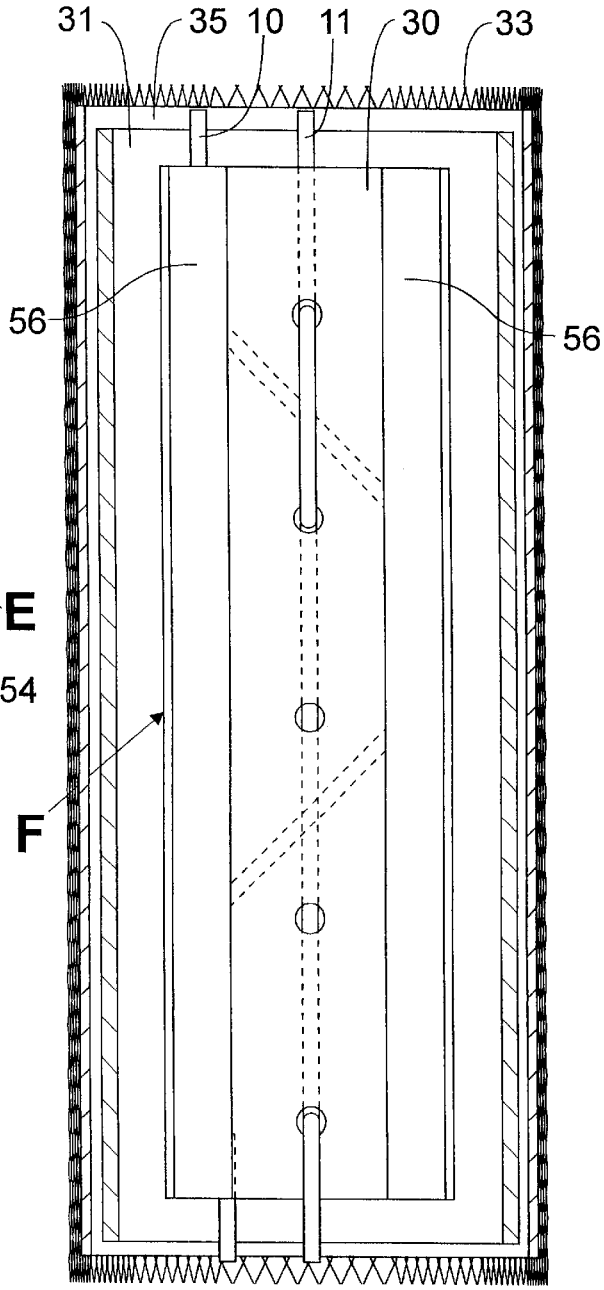
FIG. 22 illustrates interconnect F of the invention, in which the insulating perforated tube has external ribs for spacing a tubular jacket away from the bare conductors and the jacket is surrounded by a spiral-wrapped foil shield surrounded by a woven metallic shield.

Referring to FIG. 22, interconnect F includes a spirally wrapped metallic shield 35, surrounded by a woven metallic shield 33, and surrounding tubular jacket 31.

Figure 23C:
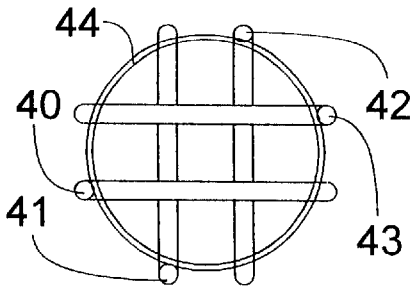
FIG. 23C is a top view of interconnect G of the invention.
Figure 23A:
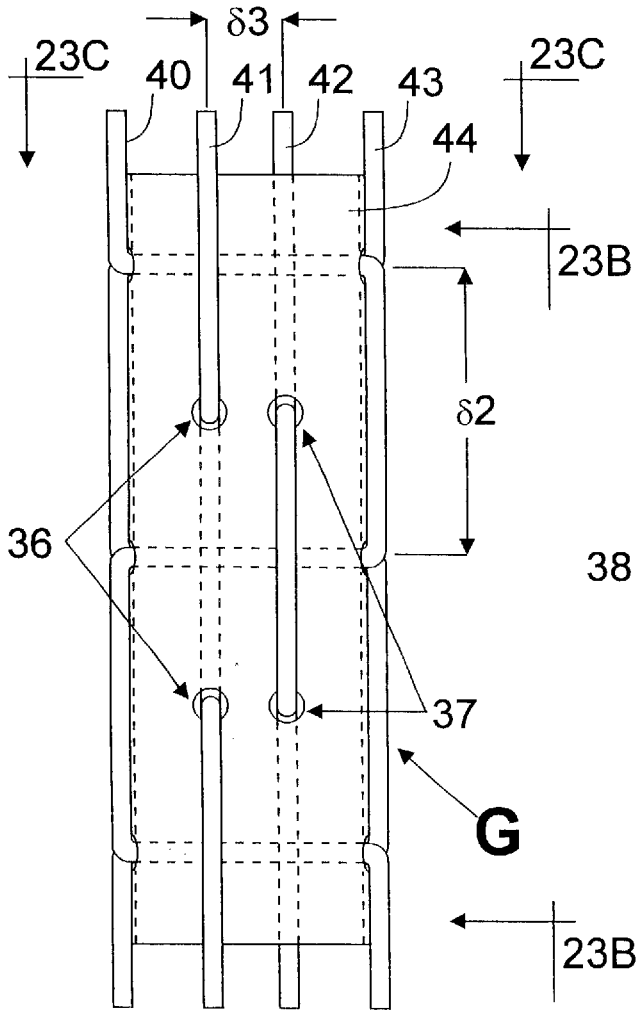
FIG. 23A illustrates an interconnect G of the invention, an alternate embodiment in which four conductors are woven through an insulating tube, each forming a square-wave pattern.
Figure 23B:
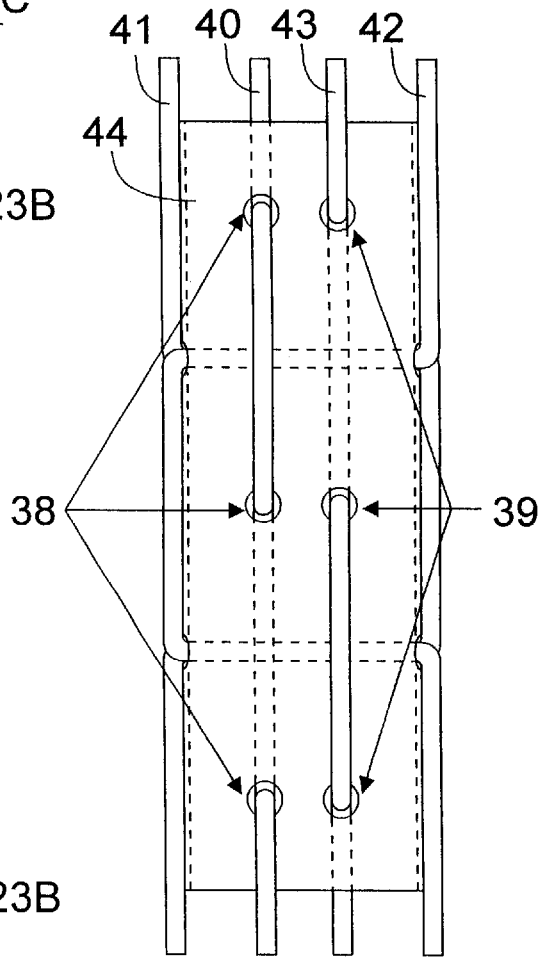
FIG. 23B is a side view of interconnect G of the invention, rotated radially 90 degrees from the view of FIG. 23A.

Interconnect G, an alternate configuration using two conductor pairs is illustrated in FIGS. 23A, 23B and 23C. Referring to FIG. 23A of the drawings, interconnect G comprises a first conductor 40, a second conductor 41, a third conductor 42, a fourth conductor 43 and a conductor support structure, such as a perforated insulating tube 44. The bare conductors are all preferably composed of solid copper, silver, tinned copper or silver plated copper, or other conductive material, and in the same gauge, generally ranging from 26 AWG to 18 AWG. Preferably, conductors 1 and 2 are bare wires, but alternatively one or both may be partially or completely insulated. Insulating tube 44 may be composed of PVC, Teflon, polypropylene, polyethylene or other flexible insulating material.

Referring again to FIG. 23A, tubing 44 is perforated with a first, second, third and fourth series of holes which are in parallel with the axis of tube 44 and evenly spaced axially at an interval distance $\delta 2$. The first series of holes 36 extends through two sides of the wall of tube 44. The second series of holes 37 extends through two sides of the wall of tube 44, being offset a distance $\delta 3$ from the first series of holes 36. The third series of holes 38 extends through two sides of the wall of tube 44, being parallel with the axis of tube 44, rotated radially 90 degrees from holes 36 and offset axially a distance $\delta 2/2$ from holes 36 as illustrated in FIGS. 23C and 23B. The fourth series of holes 39 extends through two sides of the wall of tube 44, being aligned parallel to the axis of tube 44, offset axially a distance $\delta 2/2$ from holes 37 and rotated radially 90 degrees from holes 37 as illustrated in FIGS. 23C and FIG. 23B.

In FIG. 23A conductor 41 is woven through holes 36 forming a square-wave pattern. Conductor 42 is woven through holes 37 forming a square-wave pattern that is a mirror image of the pattern of conductor 41, as illustrated in the view of FIG. 23B. Conductor 40 is woven through holes 38 forming a square-wave pattern. Conductor 43 is woven through holes 39 forming a square-wave pattern that is a mirror image of the pattern of conductor 40 as illustrated in the view of FIG. 23A. Thus, conductors 41 and 42 are maintained in spaced, generally helical relationships with conductors 40 and 43, similar to that for conductors 1 and 2. Conductors 41 and 42 may be combined at the ends of interconnect G and conductors 40 and 43 may be combined at the ends of interconnect G to form a single circuit when it is terminated to connectors.

Figure 24:
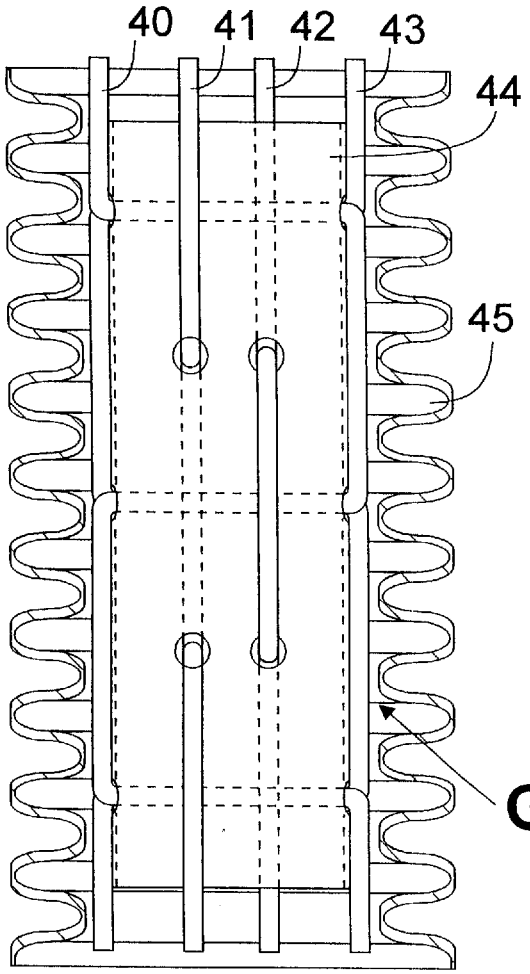
FIG. 24 illustrates interconnect G of the invention, with a section view of a surrounding corrugated jacket.

Referring to FIG. 24, interconnect G includes a surrounding corrugated jacket 45 that prevents shorting of the conductors with other metal objects. The corrugations also minimize contact of the conductors with the insulating jacket.

Figure 25:
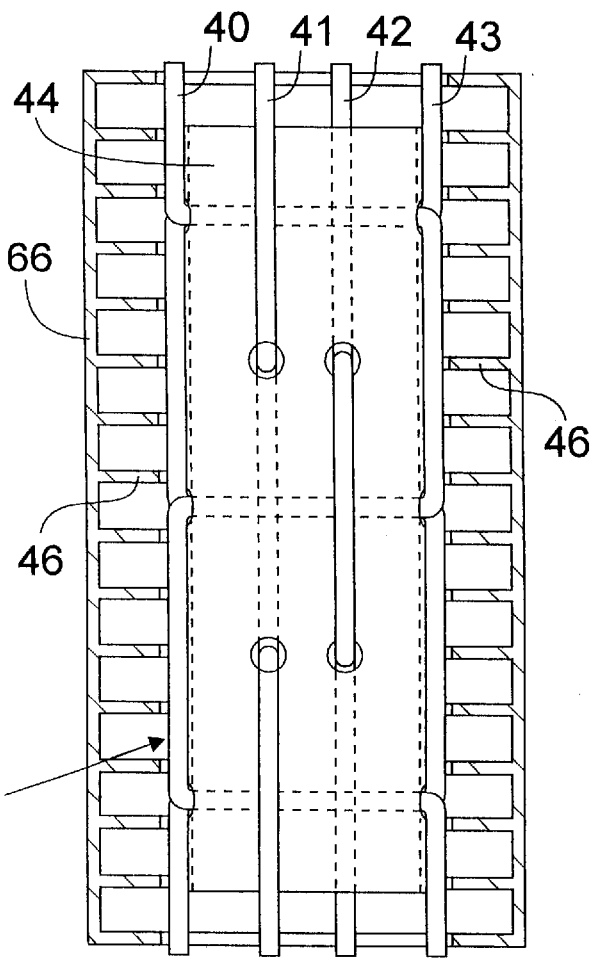
FIG. 25 illustrates interconnect G of the invention, with a section view of a surrounding insulating jacket with internal ribs.

Referring to FIG. 25, interconnect G includes a surrounding insulating jacket 66 with internal ribs 46 that prevents shorting of the conductors with other metal objects. The internal ribs 46 also minimize contact of the conductors with the jacket 66.

Figure 26:
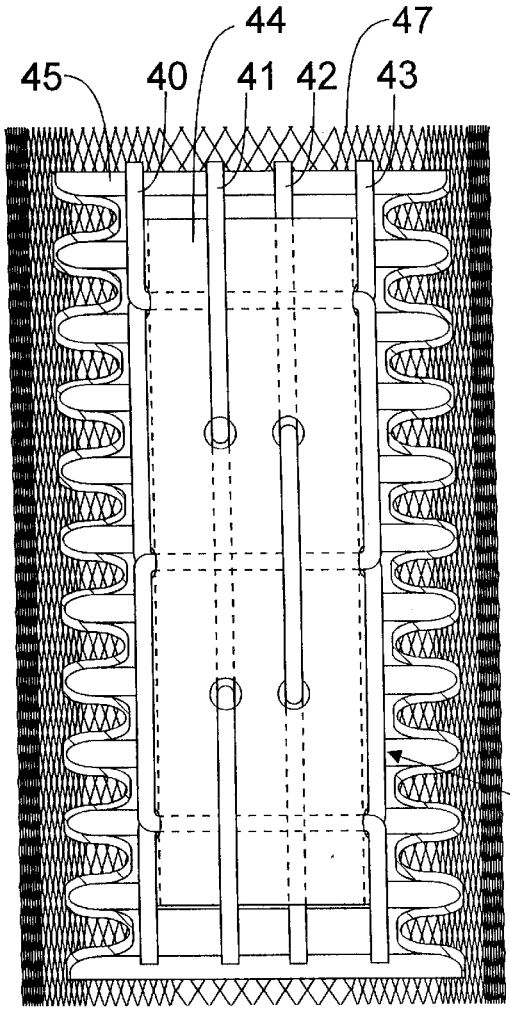
FIG. 26 illustrates interconnect G of the invention, with a section view of a surrounding corrugated jacket, further surrounded by a woven metallic shield.

Referring to FIG. 26, interconnect G includes a surrounding corrugated jacket 45 further surrounded by a woven metallic shield 47.

Figure 27:
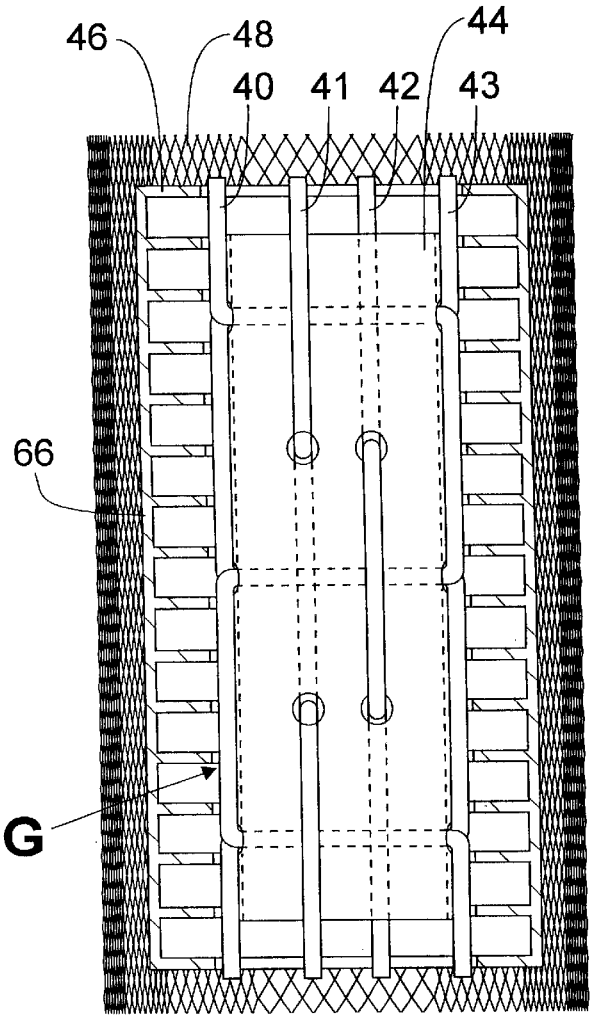
FIG. 27 illustrates interconnect G of the invention, with a section view of a surrounding insulating jacket with internal ribs, further surrounded by a woven metallic shield.

Referring to FIG. 27, interconnect G includes a surrounding jacket 66 with internal ribs 46 further surrounded by a woven metallic shield 48.

Figure 28:
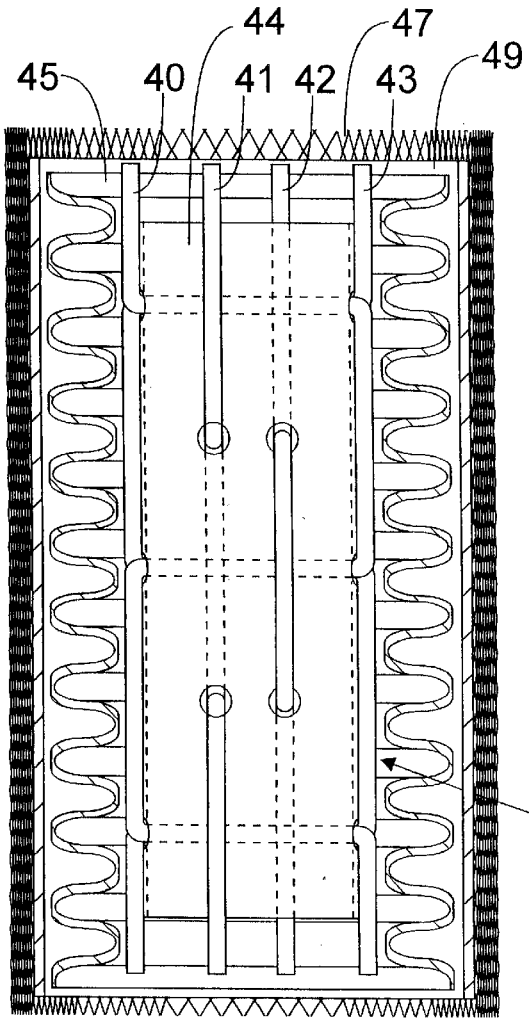
FIG. 28 illustrates interconnect G of the invention, with a section view of a surrounding corrugated jacket, further surrounded by a spiral-wrapped foil shield and a woven metallic shield.

Referring to FIG. 28, interconnect G includes a surrounding corrugated jacket 45 further surrounded by a spiral-wrapped foil shield 49 and a woven metallic shield 47.

Figure 29:
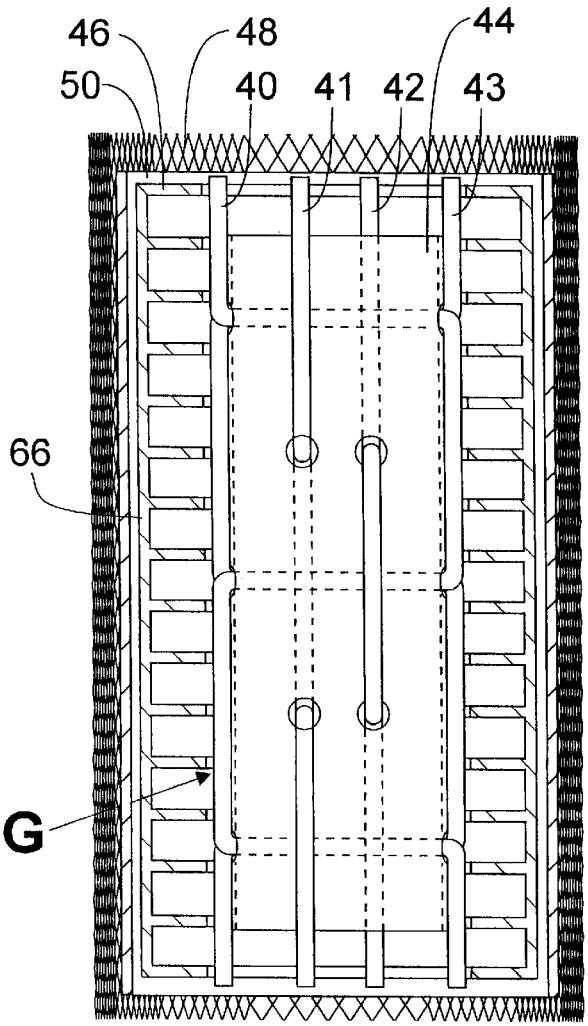
FIG. 29 illustrates interconnect G of the invention, with a section view of a surrounding insulating jacket with internal ribs, further surrounded by spiral-wrapped foil shield and a woven metallic shield.

Referring to FIG. 29, interconnect G includes a surrounding jacket 66 with internal ribs 46 further surrounded by a spiral-wrapped foil shield 50 and a woven metallic shield 48.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

What is claimed is:

1. An electrical interconnect comprising:

a first conductor, a second conductor, and a conductor support structure defining a central axis, the structure including a wall extending generally parallel to at least a portion of the central axis, the wall having a plurality of conductor support sites distributed along the wall, wherein said first and second conductors extend along at least a part of the wall and the first and second conductors are maintained in a spaced relationship with respect to one another by the conductor support sites.

2. The electrical interconnect of claim 1 further comprising a third conductor disposed generally along the central axis of the conductor support structure.

3. The electrical interconnect of claim 1 further comprising a jacket disposed around the wall and the conductors.

4. The electrical interconnect of claim 3 wherein the jacket includes ribs facing the conductors.

5. The electrical interconnect of claim 1 wherein the conductor support structure includes external ribs.

6. The electrical interconnect of claim 1 wherein at least one of the first and second conductors is substantially uninsulated.

7. The electrical interconnect of claim 1 wherein the first and second conductors are substantially uninsulated.

8. The electrical interconnect of claim 1 wherein at least one of the first and second conductors are at least partially insulated.

9. The electrical interconnect of claim 1 wherein the conductor support sites are perforations through the wall of the conductor support structure.

10. The electrical interconnect of claim 1 wherein the conductor support sites include a first set of sites and a second set of sites, the first set of sites supporting the first conductor, the second set of sites supporting the second conductor.

11. The electrical interconnect of claim 10 wherein the first set of sites is distributed along a first side and a second side of the conductor support structure, and wherein the first side and second sides are separated by about 180°.

12. The electrical interconnect of claim 10 wherein the first set of sites includes a first line of the sites distributed along the conductor support structure, and the second set of sites includes a second line of the sites distributed along the conduct support structure wherein the first line of the sites and the second line of the sites are separated radially around the conductor support structure by about 90°.

13. The electrical interconnect of claim 1 wherein the first and second conductors are disposed in a generally helical relationship with respect to one another.

14. The electrical interconnect of claim 1 further comprising a third and a fourth conductor maintained by the conductor support sites in a spaced relationship with respect to one another.

15. An electrical interconnect comprising:

a first conductor, a second conductor, and a tube defining a first end and a second end and including a wall interconnecting the first and second ends, the tube further including a plurality of perforations through the wall, wherein said first and second conductors are maintained in a spaced relationship by extending through the perforations.

16. The electrical interconnect of claim 15 further comprising a third conductor disposed generally within the tube.

17. The electrical interconnect of claim 15 further comprising a jacket disposed around the wall and the conductors.

18. The electrical interconnect of claim 17 wherein the jacket includes ribs facing the conductors.

19. The electrical interconnect of claim 15 wherein the tube includes external ribs.

20. The electrical interconnect of claim 15 wherein the perforations include a first set of perforations and a second set of perforations, the first set of sites supporting the first conductor, the second set of sites supporting the second conductor.

21. The electrical interconnect of claim 20 wherein the first set of sites includes a portion of sites distributed along a first side of the tube and a portion of sites distributed along a second side of the tube, and wherein the first side and second sides are separated by about 180°.

22. The electrical interconnect of claim 20 wherein the first set of sites includes at least a portion of the sites distributed along a line on the tube, and the second set of sites includes at least a portion of sites distributed along a line on the tube, wherein the lines are separated by about 90°.

23. An electrical interconnect comprising:

a first conductor, a second conductor, and a conductor support structure defining a first end and a second end and extending along a central axis, the conductor support structure including a wall having a plurality of perforations, wherein at least a portion of the perforations are oriented generally normal to the central axis, and wherein the first and second conductors are maintained in a spaced relationship with one another by insertion through the perforations.

24. An electrical interconnect comprising:

a first conductor, a second conductor, a conductor support structure defining a first end, a second end, and a central longitudinal axis, the conductor support structure including a support surface extending from adjacent the first end to adjacent the second, the support surface providing a plurality of conductor support sites spaced apart from the central longitudinal axis, wherein the first and second conductors extend from adjacent the first end to adjacent the second end and are maintained in a spaced relationship with respect to one another by the conductor support sites.

25. The electrical interconnect of claim 24, wherein the first conductor and the second conductor cross the central longitudinal axis of the conductor support structure in between the conductor support sites.

26. An electrical interconnect comprising:

a first conductor, a second conductor, a conductor support structure defining a central longitudinal axis, the conductor support structure including a first set of conductor support sites distributed along the conductor support structure and a second set of conductor support sites distributed along the conductor support structure, the first set supporting the first conductor, the second set supporting the second conductor, wherein the first set of sites is offset along the central longitudinal axis with respect to the second set of sites.

* * * * *